United States Patent [19]

Buchman

[11] 4,030,686

[45] June 21, 1977

[54] POSITION DETERMINING SYSTEMS

[75] Inventor: William W. Buchman, Los Angeles, Calif.

[73] Assignee: Hughes Aircraft Company, Culver City, Calif.

[22] Filed: Sept. 4, 1975

[21] Appl. No.: 610,214

[52] U.S. Cl. ..... 244/3.13; 244/3.16

[51] Int. Cl.[2] ..... F41G 7/00; F41G 7/18; F42B 15/10; F42B 15/02

[58] Field of Search ..... 244/3.13, 3.16, 3.17

[56] References Cited

UNITED STATES PATENTS

| | | | |
|---|---|---|---|
| 3,398,918 | 8/1968 | Girault | 244/3.13 |
| 3,779,492 | 12/1973 | Grumet | 244/3.17 |
| 3,820,742 | 6/1974 | Watkins | 244/3.16 |
| 3,944,167 | 3/1976 | Figler et al. | 244/3.16 |

*Primary Examiner*—Samuel W. Engle
*Assistant Examiner*—Thomas H. Webb
*Attorney, Agent, or Firm*—Lawrence V. Link, Jr.; W. H. MacAllister

[57] ABSTRACT

A system for providing signals which are indicative of a target's position along at least one dimension across an electromagnetic energy beam. The system comprises a transmitter for transmitting energy which is encoded such that the polarization state of the energy varies across the beam, and a receiver which responds to the polarization of the received energy to provide signals indicative of the relative position of the target within the beam.

8 Claims, 9 Drawing Figures

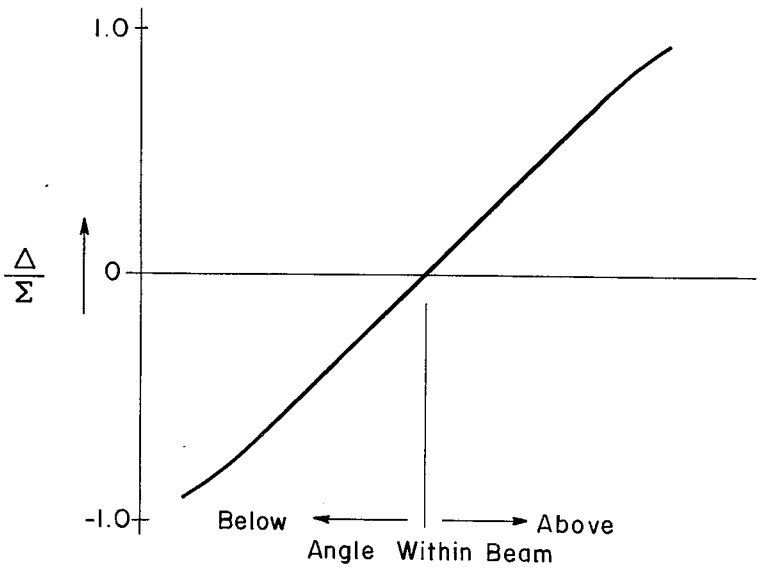
Fig. 9.
Fig. 7.
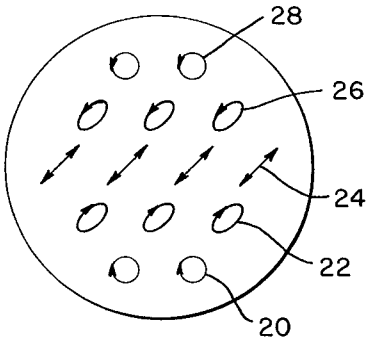
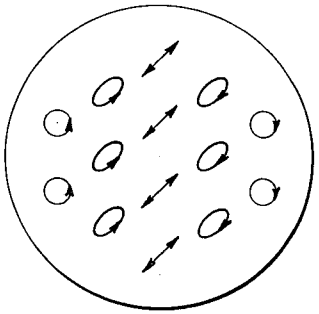
Fig. 8.

POSITION DETERMINING SYSTEMS

BACKGROUND OF THE INVENTION

This invention relates to position determining systems generally and is particularly adapted to such systems which provide guidance for missiles or aircrafts or which determine the location of objects.

One application for the subject invention is in the field of optical beam riding missile guidance systems which operate to cause a missile to fly down the center of a transmitted beam. One prior such type of system uses a narrow transmitted beam which is stepped about in space from pulse to pulse so as to provide position information. For example, beam 1 is transmitted at position 1 on the first transmitted pulse, beam 2 is transmitted at postion 2 on the second transmitted pulse and so forth, and the sequence is repeated until a beam has been transmitted at all preselected positions. A reference clock in the missile is synchronized at launch to a clock in the transmitter and the time of reception of an energy pulse is indicative of position with respect to the space covered by the multiple, sequentially transmitted beams.

Although the just described system may be satisfactory for many applications, it is limited by requiring a high transmission pulse rate to generate the multiple narrow beams and particularly for laser type transmitters the high pulse rate means that the useful range of the system is restricted.

SUMMARY OF THE INVENTION

A primary object of the subject invention is to provide an improved system for determining the position of remotely located objects.

A further object of the subject invention is to provide a system for determining the position of a remotely located target such that the position along at least one dimension can be determined from a single transmitted beam.

Still a further object of the subject invention is to provide an improved position determining system which is adaptable for use in optical beam rider guidance systems.

Yet another object is to provide an improved system for determining the location of a target by means which are insensitive to the roll orientation of the target.

The subject invention comprises transmitter means for transmitting a beam of electromagnetic energy such that the energy is encoded along at least one dimension across the beam; and receiver means for receiving a portion of the transmitted energy and for providing as a function of the encoded received energy, signals which are indicative of the position of a target along the encoded dimension. By transmitting beams which are encoded along different dimensions across the beam, the target's location in two dimensions may be determined.

According to one preferred embodiment, the transmitter includes means for encoding a polarization transition across the beam such that the polarization varies from elliptical polarization of a first rotational sense at one edge of the beam through linear polarization at the beam's center to elliptical polarization of the oppostie sense at the opposite edge of the beam. As used herein the term elliptical polarization includes circularly polarization as a special case thereof.

The just described polarization transition is implemented by means of a laser unit which applies linearly polarized light to a wedge of birefringent material such as crystalline quartz. The polarization of the incident laser energy is oriented at 45° to the optical axis of the wedge. The wedge decomposes the input light into two components. One of these components in along and the other is perpendicular to the optical axis of the wedge. In passing through the wedge one of the light components is phase shifted with respect to the other and preferably the configuration of the wedge is selected such that this phase shift is plus and minus 90° at the edges of the beam. With this arrangement right-handed circular polarization is encoded at one beam edge and left-handed circular polarization at the other edge. The light transmitted through the center of the wedge has substantially no relative phase shift, except for an integral number of half wavelengths, between the two orthogonal components thereof and its polarization state is substantially the same or orthogonal to that of the input to the wedge. The output light from the wedge is passed through a diverging lens which spreads the beam to obtain the desired angular beam width, e.g. a conical beam.

In the above just described embodiment, the receiver includes a quarter wave plate, with fast and slow axes at 45° to the horizontal, which converts purely circularly polarized light into horizontally or vertically polarized light depending on the "handedness" of the input polarization. The relative proportions of the two circular components of the received energy is established by means of a polarization sensitive beam splitter which functions to apply the horizontal component of the energy from the quarter wave plate to a first detector and the vertical component to a second detector. The ratio of the difference of these components to their sum is indicative of the position of the received energy along the just described embodiment, as the receiver rotates in roll the quarter wave plate and the beam splitter rotate together so that the position determining measurement is substantially independent of roll even thought the various axes deviate from the horizontal and vertical.

Position information along a second dimension across the beam can be obtained by rotating the wedge in its optical plane and transmitting a second pulse. Rotating the wedge 90° between pulses alternately provides elevation and azimuth type position information. Instead of rotating the wedge, optical arrangements may be utilized so that the laser energy is optically rerouted through a second suitably angularly oriented wedge during the periods for measurement along the second dimension or two lasers may be used to implement parallel channels which are alternately energized.

In yet another embodiment, two channels simultaneously transmit energy of different frequencies and two dimensional position information is provided during each transmission period. In this monopulse configuration of the subject invention, signals at first and second frequencies are each encoded by the above described elliptical polarization transitions such that the encoded dimensions through the beam are orthogonal to one another. The receiver includes a dichroic beam splitter arranged such that the two frequencies may be separately processed and the polarization information encoded thereon provides position information along both dimensions, e.g. azimuth and elevation, from a single transmitted pulse.

In accordance with a further embodiment of the invention, the transmitted beam is encoded so that a varying angle of linear polarization is impressed across the measurement dimension of the beam; and the receiver need only comprise a polarization sensitive beam splitter for dividing the received energy between two detectors whose outputs are indicative of the relative position of the received energy within the transmitted beam.

Applications for the subject invention include, but are not limited to, optical beam riding systems, airport landing aids, guidance of remotely piloted vehicles (RPV) and tracking of projectiles or missiles. In the guidance applications, the receiver may be carried on the vehicle to be guided or alternately the receiver may be located at the transmitting site with, for example, a suitabe retroreflector being utilized to reflect a portion of the transmitted energy from the vehicle to the receiver for position determination. Command information for vehicle guidance might in turn be relayed, e.g. telemetered, to the vehicle.

BRIEF DESCRIPTION OF THE DRAWINGS

The novel features of this invention, as well as the invention itself, will be better understood from the accompanying description taken in connection with the accompanying drawings in which like reference characters refer to like parts and in which:

FIGS. 7 and 8 depict patterns of polarization encoding applied to transmitted beams in accordance with some embodiments of the inventions; and FIG. 9 is a graph of the system's output signals relative to the position of a target within the beam, and is useful for explaining the applications of systems in accordance with the invention.

DETAILED DESCRIPTION OF THE PREFERRED EMBODIMENTS

Figure 1:
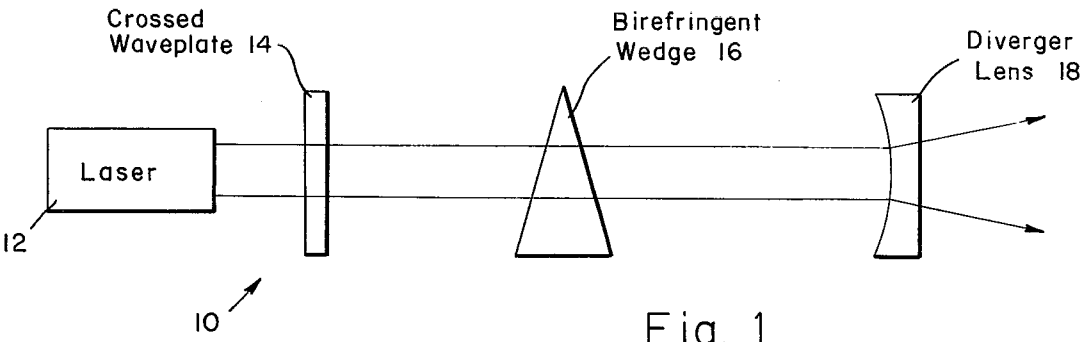
FIGS. 1 and 2 are block and schematic diagrams of the transmitter and receiver, respectively, of an embodiment of the subject invention which provides signals indicative of the position of the target along one dimension across a transmitted beam of electromagnetic energy.

Referring first to FIG. 1, transmitter 10 includes a laser unit 12, a crossed wave plate 14, a birefringent wedge 16 and a beam expander (diverger) lens 18. Laser unit 12 is arranged such that the electric field (E vector) of its output beam is oriented at 45° to the vertical. Birefringent wedge 16, which in the embodiment of FIG. 1 may be composed of quartz, has its optical axis oriented in a vertical direction and the input energy applied to wedge 16 is broken up into "slow" and "fast" components having polarizations parallel and perpendicular, respectively, to the optical axis. For the 45° orientation of the optical axis relative to the applied energy polarization, the just mentioned two energy components are equal and the amount of phase shift accumulated for said two components is proportional to the thickness of the wedge through which the energy travels. The position of the wedge in the beam is preferably adjusted such that the phase shift of the center of the beam is a whole number of half wavelenghts and the energy leaving the wedge at the center thereof is linearly polarized.

The angle between the front and rear sloping faces of wedge 16 is selected so that at the edges of the beam, in the direction of the wedge, the phase shift is 90° more at one edge and 90° less at the other. Thus, the energy leaving at one of said 90° points is right-handed circularly polarized while the energy at the other 90° point is left-handed circularly polarized. In between the beam edges the polarization of the energy varies through elliptical polarization of one handedness to linear polarization at center of the beam and then through elliptical polarization of the opposite handedness to the circular polarization.

Although the minimum thickness of wedge 16 required to implement the just described polarization encoding is extremely small, in practice, the average thickness of the wedge corresponds to mant wavelengths of birefringent phase shift. However, using a laser which provides energy at substantially a single wavelength, allows the use of such a high order retardation plate (wedge 16) without serious degradation. Temperature changes, however, can affect the amount of retardation and crossed waveplate 14 is included in transmitter 10 so as to compensate the average retardation bias introduced by the wedge, and to thereby minimize effects of temperature changes. The optic axis of crossed waveplate 14 is oriented horizontally.

After the polarization has been encoded by wedge 16 the energy is applied through diverging or expander lens 18. Hence, the space covered by the beam is coded by various polarization states within the beam volume and the state of received polarization is indicative of the position of the received portion of the energy within the transmitted beam. FIG. 7 is a simplified illustration of the transition of the polarization from right-handed circular polarization at plane 20 at one edge of the beam through right-handed elliptical polarization at plane 22, linear polarization at plane 24, left-handed elliptical polarization at plane 26 and left-handed circular polarization at the opposite edge of the beam at plane 28. Similarly, FIG. 8 depicts the encoded polarization that would be used to measure position along an orthogonal dimension to that illustrated in FIG. 7.

Figure 2:
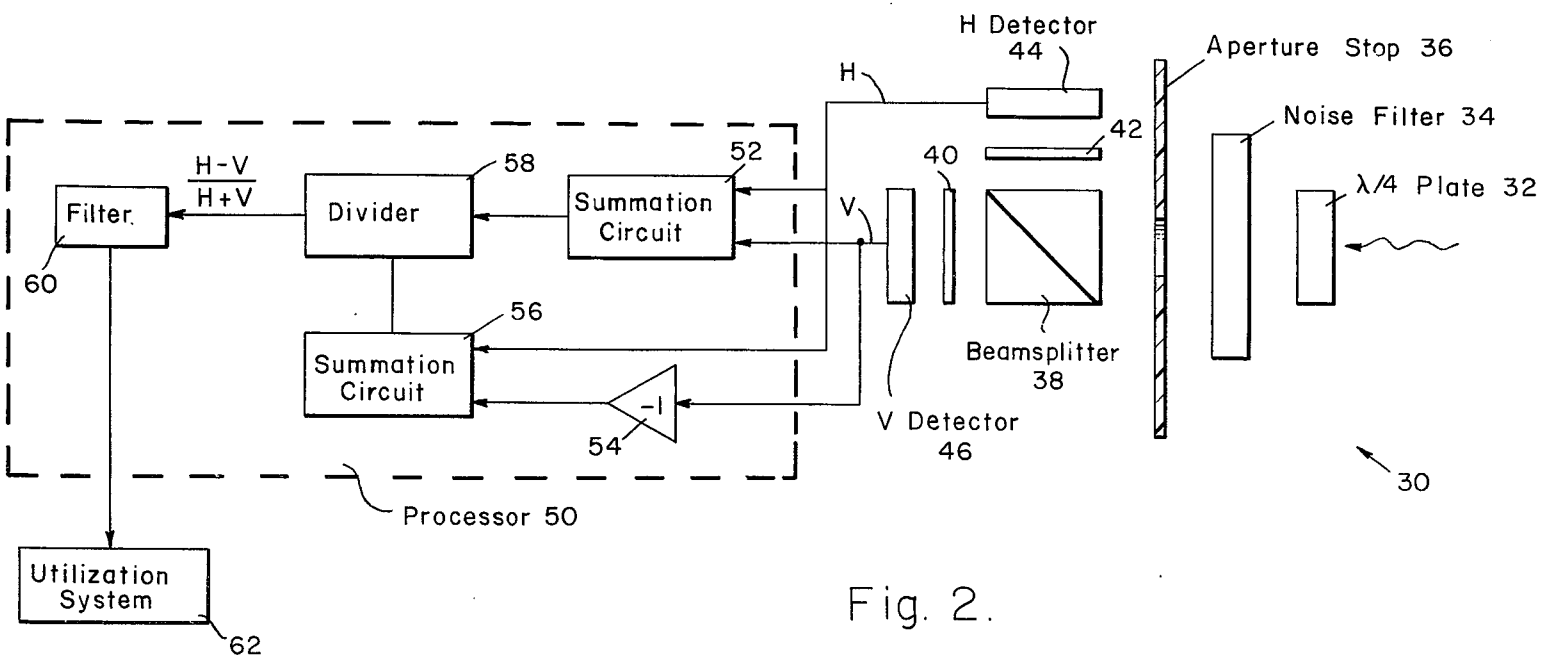

Referring now primarily to FIG. 2, receiver 30 reverses the just described encoding with the exception that the birefringent plate is not wedged but rather is implemented by means of a quarter wave plate 32. The output energy from quarter wave plate 32 is applied through a relatively narrow bandwidth background noise filter 34, through the aperture of stop 36 to polarization sensitive beam splitter 38. Beam splitter 38 applies horizontally polarized energy to a horizontal detector 44 and vertically polarized energy to a vertical detector 46. The output signals from detectors 44 and 46 are applied in parallel to a processor 50.

In the operation of receiver 30, the quarter wave plate introduces a 90° phase shift between linearly polarized components along the fast and slot axes as they pass through.

For example, a purely circularly polarized wave is converted into a linearly polarized wave with its polarization oriented at ±45° with respect to the quarter wave plates optic axis. The sign of the orientation angle depends on the handedness of the circularly polarized energy applied to quarter wave plate 32. Polarization sensitive beam splitter 38 is oriented with the projection of the normal to its beam splitting surface on quarter wave plate 32 and 45° to the optic axis of the quarter wave plate and function to separate the two orthogonal polarization components. Ideally, the beam splitter applies only horizontally and vertically polarized energy to detectors 44 and 46, respectively; however, polarization filters 40 and 42 are included to insure the polarization separation and are oriented so as to pass only horizontally and vertically polarized energy, respectively, to detectors 44 and 46. Polarization filters 42 and 44 may be of any suitable type such as the "Polaroid" type HR sheet which is suitable for the near infrared spectral region. In applications where the degree of polarization separation provided by filter 42 and 44 is adequate, beam splitter 38 need not be of the polarization sensitive type.

Narrow bandwidth filter 34 is used to minimize the effect of background radiation noise. Detectors 44 and 46 could be, for example, 10mm diameter Schottky barrier diode detectors of the type manufactured by United Detector Technology. The apertures stop 36, which may have a 5mm diameter aperture, for example, limits the amount of energy collected by the detectors. The purpose of this "limiting aperture" is to minimize the effect of atmospheric scintillation on the position measurement signals, by insuring each detector collects energy from the target over the identical optical path.

It is noted that in accordance with the principles on the invention receiver 30 could be implemented by means of two closely spaced apertures each associated with a quarter wave plate, a polarization sensitive filter and a detector, or even with the detector sensitive area defining the aperture. However, atmospheric turbulence caused variations between the signals passing through each of the apertures is believed to be of sufficient disadvantage to make the embodiments shown in FIG. 2 preferable in many applications.

Still referring primarily to FIG. 2, processor 50 implements the term (H−V)/(H+V) (sometimes referred to as $\Delta/\Sigma$) wherein the signal designated H is the output from detector 44 and the signal designated V is the output from detector 46. A plot of this function ($\Delta/\Sigma$) is presented in FIG. 9 and as is evident therefrom it is a substantially linear function, at least for relatively small angles from boresight.

In some applications, the receiver is not carried by the target but receives the transmitted energy after it is reflected by a retroreflector, such as a metallized cube on the target. It is noted that since the handedness of the polarization is reversed upon reflecting that in such application the sense of the output signal $\Delta/\Sigma$ will be reversed. For example, if in the applications where the receiver is carried by the target a positive $\Delta/\Sigma$ signal is indicative of above beam center, in the retroreflector application a positive $\Delta\Sigma$signal would be indicative of below beam center.

Although the linearity of the transfer function depicted in FIG. 9 may be of importance in some applications, in others such as missile beam riding, or glide slope landing aids, the linearity of the function is of lesser importance inasmuch as the purpose of the system is to direct the vehicle being guided along the center of the beam (the zero $\Delta/\Sigma$ condition). For example, in the missile guidance application, the flight control system would respond to the output signal from processor 50 so as to drive that signal to zero, i.e. the appropriate control surface would be positioned in response to the output signal from processor 50 until the signal is zeroed.

In processor 50, circuit 52 forms the term H+V and circuits 54 and 56 form the term H−V. The output signal from summation circuit 56 is divided within divider 58 by the output signal from circuit 52 and the resultant quotient signal is applied through a filter 60, for smoothing and noise rejection, to utilization system 62. It may be desirable that adjustable gains be provided to compensate for channel imbalance.

It is noted that processor 50 could be a portion of the utilization system which would then respond directly to the H and V signals from receiver 30. In a missile beam riding application, for example, the system 62 may further include a thresholding circuit followed by a self-gating sample and hold circuit so that the pulse signal from filter 60 is sampled and maintained between pulse periods.

Figure 3:
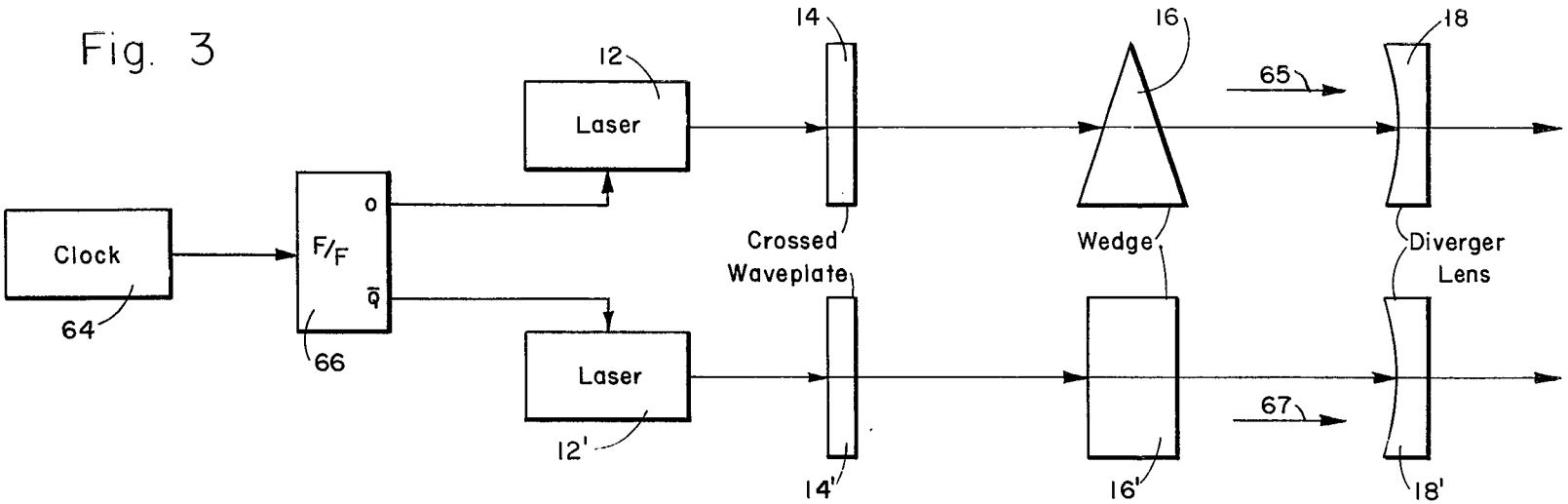
FIGS. 3 and 4 are block and schematic diagrams of the transmitter and receiver, respectively, of an embodiment of the invention which provides signals indicative of the position of a target along two nonparallel dimensions across a transmitted energy beam and which includes means for measuring the position along each of the dimensions on alternate transmitted beams.

FIG. 3 shows an embodiment of the invention for measuring the position of a target along two orthogonal dimensions across the beam. As shown in FIG. 3, a reference clock 64 drives a flip-flop circuit (F/F) 66 the output signals from which trigger lasers 12 and 12' on alternate clock pulses, respectively. The output energy from laser 12 is processed through crossed plate 14 birefringent wedge 16 and is then transmitted by beam diverger lens 18.

Processing path 67 includes laser 12', crossed wave plate 14', birefringent wedge 16' and diverger lens 18' and the processing function of channel 67 is identical to that of channel 65, and to that of transmitter 10 described hereinabove relative to FIG. 1, except that in channel 67 the birefringent wedge 16' is rotated 90° in its plane relative to the position of wedge 16. This orientation of the wedge results in the polarization state encoded across the beam being rotated 90° also. For example, if the polarization pattern of FIG. 7 is implemented by channel 65 then the pattern of FIG. 8 would be provided by channel 67. Diverger lens 18 and 18' may be positioned as close together as possible so that the offset between the beams is small; and any such offset may be readily compensated by including a corresponding voltage offset in the processors or the utilization system.

Other means for implementing the patterns of FIGS. 7 and 8 on alternate transmitted pulses will become readily apparent to those skilled in the art. For example, instead of using two lasers as is shown in FIG. 3 the output energy from a single laser may be switched between channels 65 and 67 by means including an interlaced mirror. Another alternative method would be to use a single channel in which the prism is rotated between each transmission period between the positions described for prisms 16 and 16'.

Figure 4:
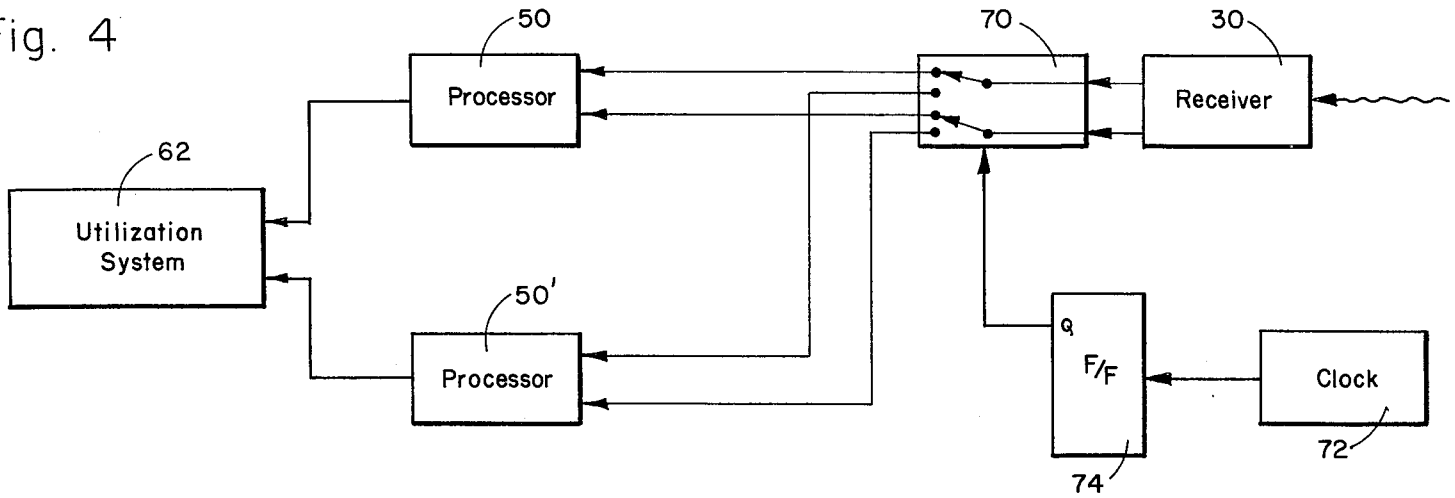

Referring now primarily to FIG. 4, the received energy is processed through receiver 30 in a manner that is identical to that described hereinabove relative to FIG. 2 and the output signals H and V are processed through a switching unit 70. Unit 70 is shown as a mechanical double throw, double pole switching arrangement in the interest of clarity of the illustration; however, it will be understood that in practice an electronic switching arrangement, such as one comprising FETs would be implemented. A reference clock 72 drives a flip-flop circuit 74 the output of which controls switching unit 70 such that the signals from receiver 30 are applied to processors 50 and 50' on alternate pulses from clock 72.

Clock 72 in the receiver is synchronized with the clock 74 in the transmitter. For example in the missile guidance application the clocks are synchronized just prior to missile launch. Hence, during the periods that the polarization pattern of FIG. 7 is encoded on the transmited beam the output signals from receiver 30 are coupled through to elevation processor 50; and during periods that the polarization pattern illustrated in FIG. 8 is encoded on the transmitted beam the output from receiver 30 is coupled through to azimuth processor 50'. The information applied to processors 50 and 50' is processed in the same manner as described hereinabove relative to FIG. 2 and is then applied to utilization system 62, wherein it is used to control the effective elevation and azimuth control surfaces, respectively, of the vehicle. It is noted that if desired, processor 50 could be time shared, with switch 70 at the output thereof. In this configuration processor 50' would not be required.

Figure 5:
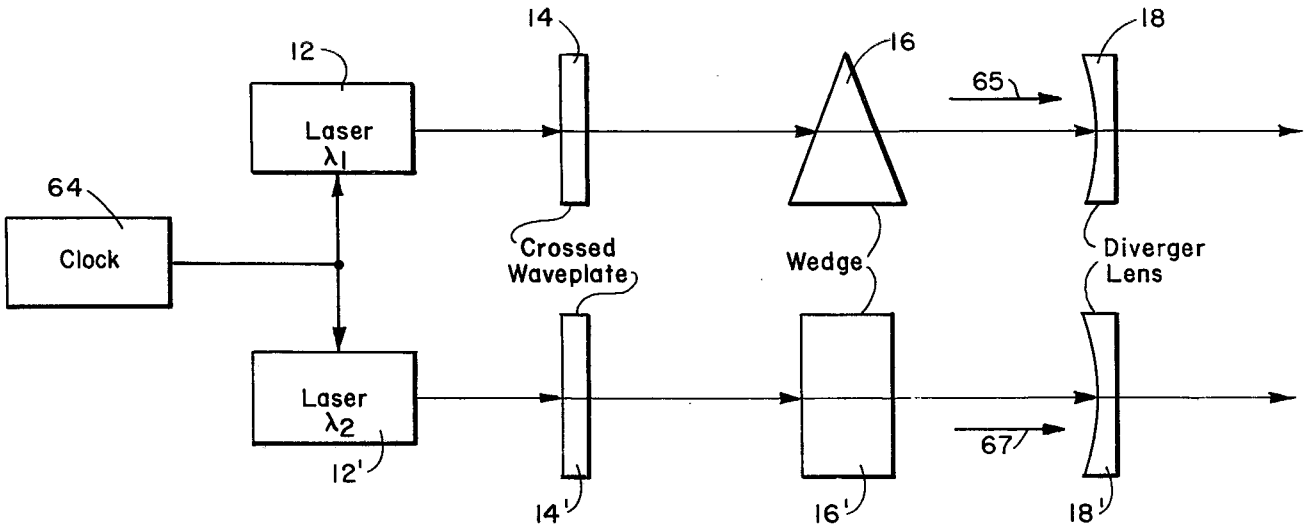
FIGS. 5 and 6 are block and schematic diagrams of a transmitter and receiver, respectively, for a monopulse embodiment of the invention wherein the position of the target is measured along each of two nonparallel dimensions across the beam during each transmission interval.

FIG. 5, to which reference is now primarily directed, illustrates a "monopulse" implementation of the principles of the subject invention whereby the transmitted beam is encoded such that the position along orthogonal dimensions across the beam may be determined from each transmitted pulse interval. As shown in FIG. 5, lasers 12 and 12' are triggered on each output signal from clock 64.

In the embodiment of FIG. 5, the energy transmitted by lasers 12 and 12' are of different frequencies and the energy at wavelenth $\lambda_1$ is encoded in accordance with the pattern shown in FIG. 7, and the energy at wavelength $\lambda_2$ in accordance with the pattern of FIG. 8.

Figure 6:
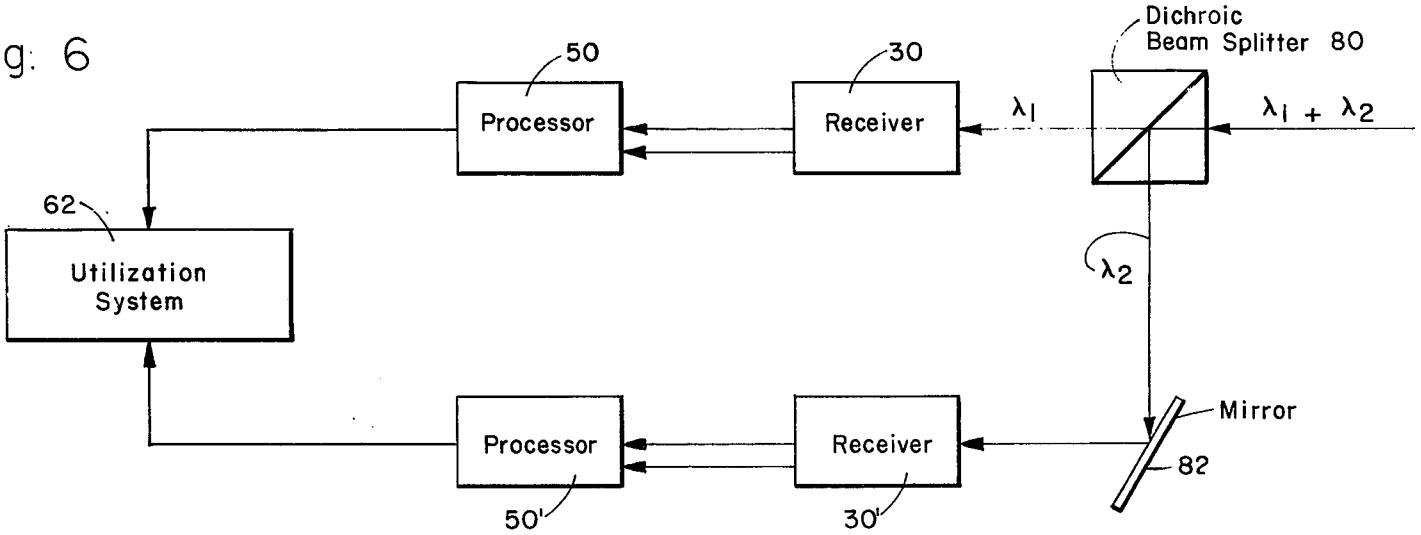

A portion of the energy from the transmitter of FIG. 5 is received by the arrangement shown in FIG. 6 which includes a dichroic beam splitter 80. The received energy at wavelength $\lambda_1$ is reflected from the beam splitter to a receiver 30 and the energy at wavelength $\lambda_2$ is reflected to a receiver 30'. Receiver 30 and processor 50 provide an output signal to utilization system 62 which is indicative of the elevation position of the target, while receiver 30' and processor 50' provide a signal to utilization system 62 which is indicative of the azimuth position of the target. In an alternate arrangement dichroic beam splitter 80 may be replaced by a first filter (not shown) which passes wavelength $\lambda_1$ and is disposed in the path of the received energy applied to receiver 50; and by a second filter (not shown) which passes wavelength $\lambda_2$ and is disposed in the path of the received energy applied to receiver 50'.

It is noted that in the above described embodiment in which elliptical polarization encoding of the transmitted beam is used that the operation of the positioning determining system is immune to the roll of the vehicle carrying the receiver. On this last point it should be noted with respect to FIG. 2, for example, that the quarter wave plate and the beam splitter would rotate together so that no roll dependency is introduced by the receiver and as mentioned above the circular polarization eliminates the roll factor from the encoded information.

For systems where immunity from effects of roll on the receiver are not important the subject invention may be modified so that the angle of polarization varies linearly across the beam width. For example, in the embodiment of FIG. 1 the prism 16 would be formed of optically active material such as sugar crystals or crystalline quartz. The quartz would be used with the beam propagating along the optic axis. Quarter-wave plate 32 would be deleted from the receiver shown in FIG. 2.

Thus having described a new and useful system for determining the position of a remotely located object, what is claimed is:

1. A system for providing position signals comprising:

first means for transmitting a beam of electromagnetic energy which has encoded thereon, as a polarization state of the energy, angular position along at least one dimension across said beam with the transition of the polarization state being from elliptical polarization of a first sense at one edge of the beam, through linear polarization, to elliptical polarization of the opposite sense at the opposite edge of the beam; and second means for receiving a portion of said transmitted energy, decoding its polarization state and providing therefrom position signals indicative of the angular position of the received energy within said beam and along said dimension.

2. The system of claim 1 wherein said first means comprises a laser transmitter unit, and a wedge of birefringent material disposed such that energy from said laser passes through said wedge.

3. The system of claim 2 wherein said first means further comprises a beam diverger disposed such that the energy from said wedge passes through said beam diverger.

4. The system of claim 1 wherein said second means includes a quarter wave plate, two detectors, and polarization separation means, disposed between said quarter wave plate and said detectors, for applying energy of one polarization to one of said detectors and energy of another polarization to the other of said detectors; whereby the output signals from said two detectors are indicative of the position along said one dimension across said beam.

5. A system for providing position signals comprising:

first means for transmitting a beam of electromagnetic energy which has encoded thereon, as a polarization state of the energy, angular position within said beam, said first means including means for sequentially transmitting beams of electromagnetic energy with the polarization state of the energy being encoded across said beams such that the transition of the polarization state is from elliptical polarization of a first sense at one edge of the beam, through linear polarization, to elliptical polarization of the opposite sense at the opposite edge of the beam, and with said polarization state being encoded along a first dimension for a first group of said transmitted beams and along a second nonparallel dimension for a second group of said transmitted beams; and second means for receiving a portion of said transmitted energy, decoding its polarization state and providing therefrom position signals indicative of the angular position of the received energy within said beam, said second means including means for providing as a function of the polaraization state of the received energy from each beam of said first group of transmitted beams, signals indicative of the position within said beam along said first dimension and for providing as a function of the polarization state of the received energy from each beam of said second group of transmitted beams, signals indicative of the position within said beam along said second dimension.

6. The system of claim 5 wherein said first means comprises a laser transmitter unit and a wedge of birefringent material disposed such that energy from said laser passes through said wedge.

7. A system for providing position signals comprising:

first means for transmitting a beam of electromagnetic energy which has encoded thereon, as a polarization state of the energy, angular position along first and second dimensions across said beam such that the polarization state of energy at a first wavelength is encoded along the first dimension and energy at a second wavelength is polarization encoded along the second nonparallel dimension; and second means for receiving a portion of said transmitted energy, decoding its polarization state and providing therefrom position signals indicative of the angular position of the received energy within said beam and along said first and second dimensions as a function of the polarization state of received energy at the first and second wavelengths, respectively.

8. The system of claim 7 wherein said first means includes means for encoding said polarization states of the energy such that the transition of the polarization state is from elliptical polarization of a first sense at one edge of the beam, through linear polarization, to elliptical polarization of the opposite sense at the opposite edge of the beam.

* * * * *